United States Patent [19]

Davis

[11] 4,416,131

[45] Nov. 22, 1983

[54] PROCESS AND APPARATUS FOR MONITORING LENGTH AND DIAMETER OF HELICAL CORRUGATED PIPE

[75] Inventor: Walter Z. Davis, Spokane, Wash.

[73] Assignee: Helical Control Systems, Inc., Spokane, Wash.

[21] Appl. No.: 337,411

[22] Filed: Jan. 6, 1982

[51] Int. Cl.[3] ..... B21C 37/12

[52] U.S. Cl. ..... 72/12; 72/49

[58] Field of Search ..... 72/10, 11, 12, 49, 50, 72/133, 135, 137, 138, 143, 145; 228/17.7, 145, 146, 147

[56] References Cited

U.S. PATENT DOCUMENTS

| | | | |
|---|---|---|---|
| 3,092,056 | 6/1963 | Ohnstad | 72/143 |
| 3,192,749 | 7/1965 | Eckhardt | 72/49 X |
| 3,217,402 | 11/1965 | Eckhardt | 228/17.7 X |
| 3,256,724 | 6/1966 | Wiley | 72/136 |
| 3,309,003 | 3/1967 | Crawford | 72/49 X |
| 3,393,546 | 7/1968 | Fay | 72/49 |
| 3,499,307 | 3/1970 | Hutton | 72/135 |
| 3,940,962 | 3/1976 | Davis | 72/50 |
| 3,982,414 | 9/1976 | Anderson | 72/50 |
| 3,992,597 | 11/1976 | Krakow | 72/12 |
| 4,070,886 | 1/1978 | Nyssen | 72/49 |
| 4,082,211 | 4/1978 | Embry | 72/49 X |
| 4,244,202 | 1/1981 | Anderson et al. | 72/49 |

FOREIGN PATENT DOCUMENTS

| | | | |
|---|---|---|---|
| 1175636 | 8/1964 | Fed. Rep. of Germany | 72/49 |
| 2509329 | 9/1976 | Fed. Rep. of Germany | 72/49 |
| 677786 | 8/1979 | U.S.S.R. | 72/49 |

*Primary Examiner*—Ervin M. Combs

*Attorney, Agent, or Firm*—Wells, St. John & Roberts

[57] ABSTRACT

An apparatus and process for monitoring the diameter and length of a helical corrugated metal pipe while the pipe is being formed from a strip of corrugated sheet metal. The apparatus includes a sheet metal strip length sensor located on a corrugated helical metal pipe forming machine. A series of length sensors are located along a formed pipe axis and are responsive to presence or absence of the formed pipe at their locations. A digital computer receives information from the sensors and is connected to various peripheral devices. The process of monitoring the diameter and length of the pipe involves measuring sheet metal strip length, determining presence of formed pipe at the various length sensor locations, and determining pipe length and diameter as a function of sheet metal width and length of sheet metal strip used.

14 Claims, 4 Drawing Figures

PRINTER
SHUT DOWN ALARM
DISPLAY
SAW RE-TIVATION
CPU
KEYBOARD AND CONTROL INPUT
LENGTH SENSORS
STRIP LENGTH SENSOR
OTHER SENSORS

PROCESS AND APPARATUS FOR MONITORING LENGTH AND DIAMETER OF HELICAL CORRUGATED PIPE

BACKGROUND ART

Helical corrugated metal pipe is formed from an elongated strip of sheet metal. Typical pipe forming machines corrugate the sheet metal by passing it through a series of rollers; the machines then form the pipe by forcing the corrugated sheet metal through a three roll bending assembly to produce a spiral. A pipe seam is formed from interlocking flanges produced on outer sheet metal edges during sheet metal corrugation. The seam is sealed as a first interlocking corrugated sheet metal edge spirals around to meet a second interlocking corrugated sheet metal edge. The two edges meet and are joined between a set of compressive rollers.

The three roll bending assembly is a standard in the corrugated pipe forming industry, its operation is well understood. The assembly consists of a guide roll, an anvil roll, and a pressure roll. As corrugated sheet metal is forced between the rolls, the anvil roll acts as a fulcrum causing the strip to bend. The diameter is formed pipe is nominally a function of the helix angle (the angle at which the corrugated sheet metal strip is inserted between the three rolls). The inside diameter of the pipe formed is also affected by the actual width of sheet metal strip used to form the pipe, the corrugation depth, the strip thickness, the width of the corrugation containing the lockseam, and the position of the lock up rolls relative to the other bending rolls.

It is difficult to maintain an accurate pipe diameter for a long run of pipe. Industry standards dictate that inside pipe diameter cannot vary more than ½-inch under nominal value for pipes up to 48-inches in diameter and not more than 1% under nominal values for pipes greater than 48-inches in diameter (in no event may adjacent ends differ by more than 1 inch). Unfortunately, the three roll process of forming helical corrugated pipe is subject to a phenomenon known as "funneling". A pipe initially produced in a desired diameter can begin to "creep" to a progressively larger or smaller diameter. The progressively increasing or decreasing diameter pipe is rejected because it has a diameter that goes beyond its tolerance, the pipe somewhat resembling a long funnel.

Also of critical importance regarding pipe diameter accuracy is that of raw material cost. Currently, sheet metal is purchased for approximately $600 per ton. If the pipe forming machine processes 5,000 tons of sheet metal per year at $600 per ton, a 2½% saving amounts to $75,000 per year. Accurate pipe diameter is much sought after, as indicated by the prior art. A common method of controlling pipe diameter is a guide chain wrapped about the circumference of the formed pipe. The guide chain forces the pipe within a preset diameter as determined by the length of the guide chain. Illustrative of guide chain diameter control is the Ohnstad invention, U.S. Pat. No. 3,092,056 (issued June 4, 1963); the Wiley invention, U.S. Pat. No. 3,256,724 (issued June 21, 1966); and the Hutton invention, U.S. Pat. No. 3,499,307 (issued Mar. 10, 1970). A problem with this method of controlling pipe diameter is that changing to different size diameters is troublesome. Other problems include: the chain can mark, score, or deform the pipe being formed, the chain pushes the formed pipe back toward the forming rollers, and shifting of the chain about the pipe causes the diameter of the formed pipe to vary from the desired diameter.

Other methods of controlling pipe diameter involve controlling the linear speed at which the pipe is formed (Crawford, U.S. Pat. No. 3,309,003 issued Mar. 14, 1967), controlling angular shear forces within the bending rolls (Krakow, U.S. Pat. No. 3,991,597 issued Nov. 16, 1976), and adjusting the lock up rolls radially relative to the pipe axis (Davis, U.S. Pat. No. 3,940,962, issued Mar. 2, 1976).

Measuring diameter is essential no matter how the diameter is controlled; all the diameter control systems are subject to pipe funneling. The two most common methods of measuring pipe diameter are the use of a chain (the Fay invention, U.S. Pat. No. 3,393,546 issued July 23, 1968; and the Hutton invention) and using a ruler or tape measure (Davis).

The chain method is subject to the problems discussed above for chain diameter control. Due to the twisting of the links, the corrugations of the sheet metal pipe, the deformation of the pipe, and the stretching of the chain, accuracy is far from acceptable.

More commonly, a ruler or tape measure is used to measure pipe diameter. As recently as 1976 (Davis), the ruler or tape measure was advocated as a state of the art in pipe diameter measuring. It is difficult to accurately measure a corrugated helical pipe by placing a band around it, whether the band be a chain or a tape measure. The corrugations run helically around the pipe and at best, a rough measurement of the outer diameter can be obtained. Orienting the tape measure 90° to the pipe axis is very difficult. There are no axial references on the pipe and the corrugations tend to create optical confusion when attempting such alignment. The most significant disadvantage of using a tape measure or ruler is the need to stop the pipe forming process to make the measurement accurately. Continual stopping wastes time, reduces productivity, and exacerbates pipe diameter error.

In addition to pipe diameter measurement, formed pipe length is subject to certain industry standards. These standards allow a maximum of 1% cumulative length variation per shipment between length of pipe formed and length of pipe desired. Assuming $600 per ton for sheet metal and 5,000 tons of sheet metal processed anually, a 1% savings in length amounts to $30,000 per year. The combined length and diameter savings resulting from accurate measurement of diameter and length can approximate $105,000 per year.

As can be seen from the foregoing discussion, productivity and efficiency in the formation of corrugated metal pipe are hampered by current methods to meet the pipe forming industry's length and diameter requirements. Continual starting and stopping of the pipe forming machine to make measurements of formed pipe length and diameter is undesirable due to decreased efficiency and due to increased wear and tear on the pipe forming machine. While all the foregoing problems have plagued the industry for some time, the helical corrugated pipe forming art is still advocating the old methods of rulers, tape measures, and chains.

DISCLOSURE OF INVENTION

My invention involves an apparatus and process for monitoring the length and diameter of a helical corrugated metal pipe while the pipe is being formed from a strip of corrugated sheet metal.

The apparatus continually feeds a strip of sheet metal having an original width ($w_o$) to a corrugated pipe forming station. A strip length sensor continuously measures the length of the strip of sheet metal being fed to the pipe forming station. The sheet metal is fed at an angle (the helix angle $\alpha+90°$) with respect to an intended pipe forming axis. The apparatus continuously corrugates the strip of sheet metal and continuously forms the corrugated sheet metal strip into a corrugated pipe at the corrugated pipe forming station. The formed pipe is directed along the intended pipe forming axis.

A first pipe length sensor senses the presence of the formed corrugated pipe as it passes a first reference location along the intended pipe forming axis. As the pipe is formed, the leading edge passes a second length sensor for sensing the presence of formed pipe at a second reference location. The second reference location is spaced a preset distance downstream from the first reference location. The distance between the two sensors is used as a pipe length measuring value. Pipe length, calculated sheet metal width, and sheet metal strip length are used to determine the calculated mean pipe diameter ($d_m$).

The ratio of actual inside diameter ($d_i$) to calculated mean diameter ($d_m$) is a constant ($\beta$) during a given run and depends on the corrugation depth (c), the strip thickness (g), the nominal diameter, the actual strip width after corrugation, and the original strip width ($w_o$). The parameters required to calculate ($\beta$) are fixed during a given run and inside pipe diameter ($d_i$) is determined from the calculated mean diameter ($d_m$). This value is recorded and preferably displayed.

My invention includes a component for determining the total length of pipe formed as a function of calculated sheet metal width, calculated means pipe diameter, and length of sheet metal strip used to form the pipe. Through use of my invention, pipe may be formed in desired lengths and diameters with an accuracy unparalleled in the helical corrugated pipe forming industry.

BRIEF DESCRIPTION OF DRAWINGS

My invention is best understood by referring to the following drawings, in which a preferred embodiment is disclosed and where.

BEST MODE FOR CARRYING OUT THE INVENTION

Figures 1, 2:
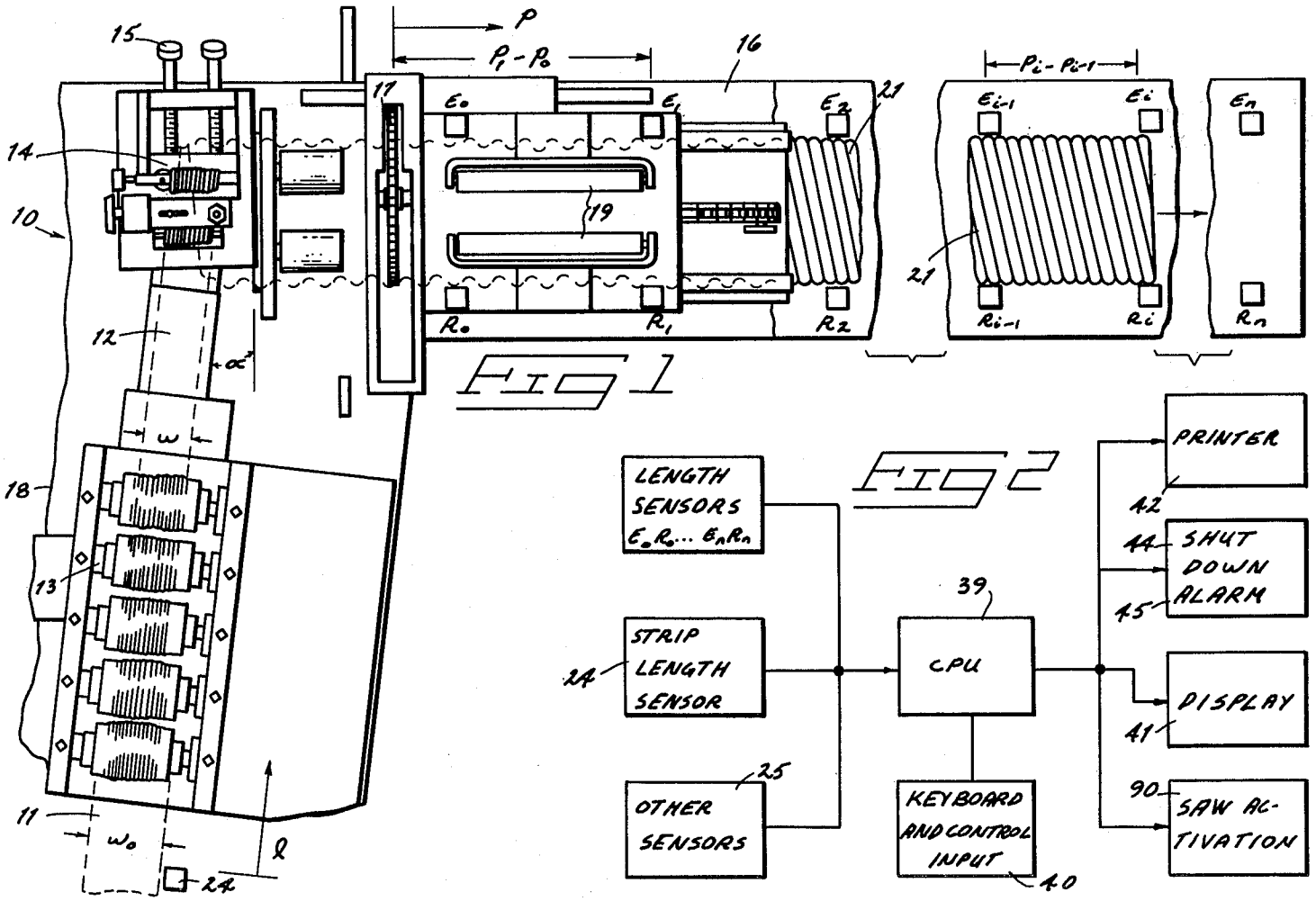
FIG. 1 is a diagrammatic view.
FIG. 2 is a block diagram.

My invention provides a process and an apparatus for monitoring the length and diameter of a helical corrugated metal pipe as the pipe is being formed. My invention provides heretofore unobtained accuracy in making these measurements. Measurements may be made continuously while the pipe forming process is being carried out.

The apparatus for monitoring the length and diameter of a helical corrugated metal pipe is installed on a helical corrugated pipe forming machine at the corrugated pipe forming station. Such machines are in common use in the helical corrugated pipe forming industry. The typical helical corrugated pipe forming machine (FIG. 1) is designated by numeral 10 in the Figs. The machine includes a machine framework 18 along which a sheet metal strip 11 is moved by a strip feeding means (not shown). The sheet metal strip 11 passes a corrugating means 13 such as a set of corrugating rollers at which point the strip is impressed with a series of corrugations and a flange along both edges. The corrugated metal strip 12 moves along the machine frame 18 to a pipe forming section consisting of pipe forming rollers 14.

The arrangement of the pipe forming rollers is well known to the pipe forming art as illustrated in the Davis U.S. Pat. No. 3,940,962, granted Mar. 2, 1976. For the sake of this discussion, the corrugated metal strip 12 is inserted between the rollers 14 at a horizontal angle referred to as the helix angle ($\alpha$). The mean diameter of the formed pipe is roughly determined by the helix angle. It is common on modern pipe forming machines to include a roller adjustment 15 to fine adjust the diameter of pipe formed.

As the corrugated metal strip 12 is inserted through the pipe forming rollers 14, it curls, or spirals forming the cylindrical pipe. The corrugated metal strip 12 curls about the intended pipe axis until edges of the strip go between the lock up rolls. The corrugated metal strip 12 has flanges on its edges and the flanges are joined at the lockup rollers to form a seal on the formed pipe seam.

The formed pipe 21 travels out of the pipe forming rollers 14 along a pipe forming axis and is carried on a pipe support bed 16 by tubular pipe bed supports 19. When a desired length of pipe is made, a saw assembly 17 is activated. In more modern pipe forming machines, the cut-off saw travels at the same speed as the pipe. The sawing process does not interrupt pipe forming. Rather, the saw travels with the pipe until the pipe is cut entirely around its circumference. At that point, the saw retracts and returns to its initial position until the formed pipe is to be cut again and the process then repeats.

My invention includes a first length sensor ($E_0R_0$) located at a first reference location ($p_o$) along the pipe bed 16 and a second length sensor ($E_1R_1$) located at a second reference location ($p_1$) along the pipe bed. Additional length sensors ($E_2R_2 \ldots E_nR_n$) are located along the pipe bed 16 at additional reference points. In the present embodiment of my invention the length sensors are preferably a series of light beam emitters and receivers; the length sensors could be microswitches, proximity devices, laser devices, or any other suitable pipe sensing device.

A strip length sensor 24 is located along the pipe forming machine frame 18. The strip length sensor 24 measures length of metal strip 11 as it is moved along the pipe machine by the strip feeding means (not shown). In the present embodiment, the strip length sensor is a rotary shaft encoder which may be commercially procured. The rotary shaft encoder provides 600 counts per revolution and has a three inch wheel that rotates as the strip moves through the machine. Other strip length sensors are acceptable and my invention should not be limited to this particular strip length sensor.

The strip length sensor 24 and the pipe length sensors ($E_oR_o \ldots E_nR_n$) (along wiith other possible sensors 25) are connected to a digital computer or central processing unit (CPU) 39 (FIG. 2). The CPU 39 provides length determining functions, diameter determining functions, and saw activation determining functions; the CPU is controlled by keyboard 40 and has an output devices—a display 41 and a printer 42. The CPU is also connected to a pipe machine stopping means, alarm signal means 45, and a saw activation means 90. The CPU 39 includes a funneling monitoring function in addition to its other functions.

The components of my invention cooperate as is indicated in FIGS. 1 and 2. The metal strip 11 is moved along the pipe machine framework 18 and corrugated. The corrugated metal strip 12 is forced through the pipe forming station pipe forming rollers 14 and pipe 21 is formed. The pipe moves out along the pipe forming axis onto the pipe bed 16.

Figure 3A:
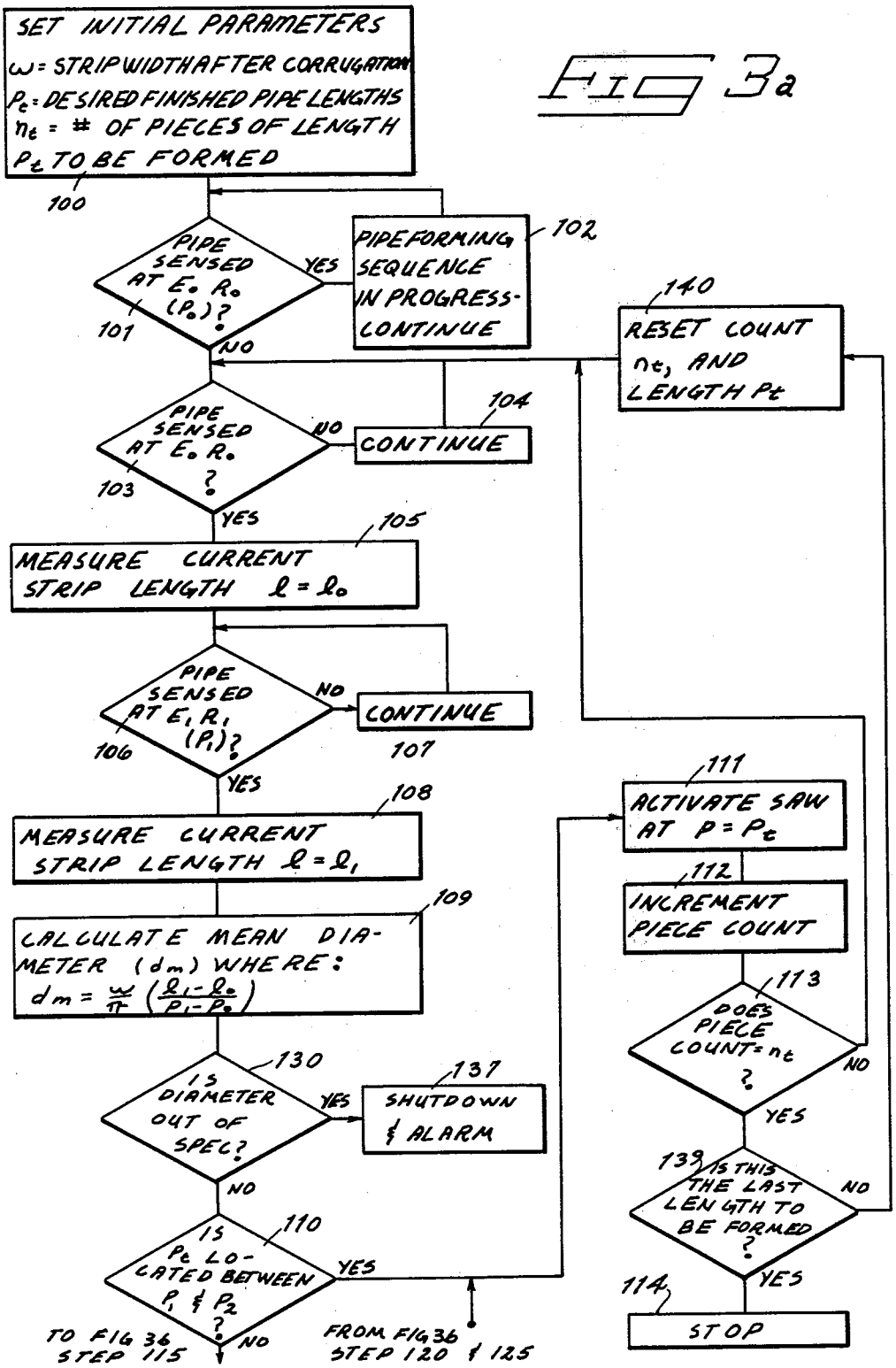
FIGS. 3*a* and 3*b* illustrate a process flow diagram.
Figure 3B:
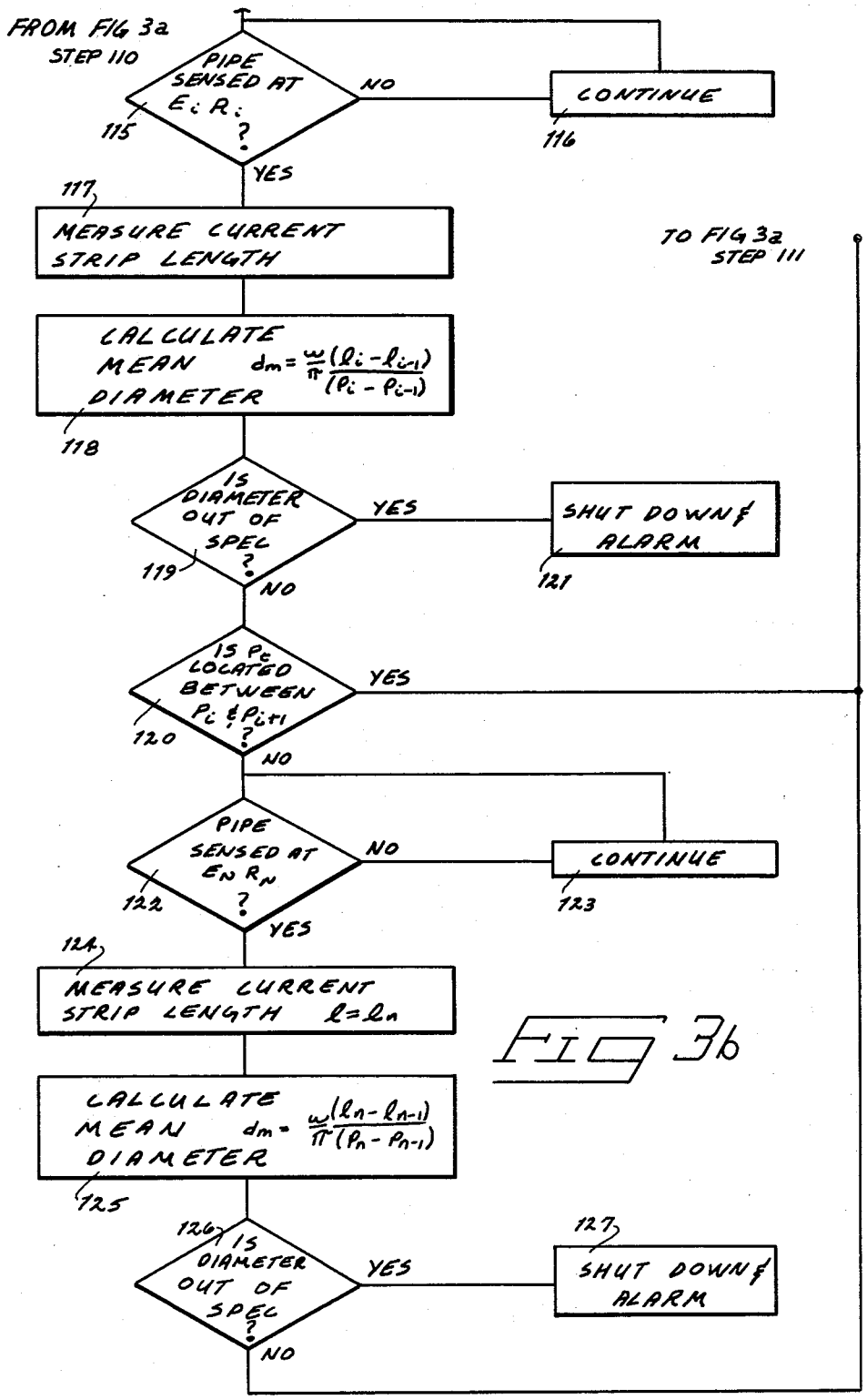

Operational control of the present invention is presided over by an instructional program resident in the CPU. FIGS. 3*a* and 3*b* illustrate a flow diagram of the program steps. In the following discussion, program "Steps" identified parenthetically in the text refer to corresponding steps in FIGS. 3*a* and 3*b*.

An operator must enter the calculated strip width after corrugation (w), strip thickness (g), nominal diameter, and original strip width ($w_o$), the desired finished pipe length ($p_t$) and the number of pieces of pipe to be formed ($n_t$). The CPU 39 retains the locations of the length sensors ($p_o, \ldots, p_n$); the corrugation depth (c), and the actual strip width after corrugation.

The CPU 39 monitors to sense formed pipe 21 at the first length sensor $E_oR_o$ (Step 101). If pipe is sensed at this location, the pipe forming sequence is in progress and the CPU waits for a break in the pipe (Step 102) before it begins its diameter and length determinations. If no pipe is sensed at the first length sensor $E_oR_o$ (Step 103) the pipe bed 16 is clear and the CPU waits (Step 104) until the pipe being formed is sensed at the first length sensor.

Once the pipe 21 is sensed at the first length sensor $E_oR_o$, the value of the count on the strip length sensor 24 ($l_0$) is loaded into memory in the CPU 39 (Step 105). As metal strip 11 is fed through the strip length sensor 24 and pipe is being formed, the strip length sensor count is continually incremented (Step 107). When sufficient pipe has been produced that its presence is sensed at the second length sensor $E_1R_1$ (Step 106) the strip length sensor count is placed in memory (Step 108). This value is the current strip length ($l_1$).

Once the current strip length used to form the pipe section between the first length sensor $E_oR_o$ and the second length sensor $E_1R_1$ is stored in the CPU's memory, the pipe section calculated mean diameter ($d_m$) is calculated (Step 109) applying the formula:

$$d_m = \frac{w}{\pi} \frac{(l_1 - l_o)}{(p_1 - p_o)}$$

In the above equation, "w" is the calculated strip width after corrugation; ($l_1 - l_o$) is the amount of strip used to form the pipe; and ($p_1 - p_o$) is the distance between the first length sensor $E_oR_o$ and the second length sensor $E_1R_1$ (which may be three to five feet depending upon accuracy desired).

Once the calculated mean diameter of a section of the pipe is determined by the CPU 39, the length of pipe 21 can be determined. If the desired pipe length ($p_t$) coincides with the location of an absolute length sensor (Step 110), the saw 17 may be activated (Step 111) at that point. In most applications, the desired length is somewhere between the length sensors and length must also be monitored by the CPU. By rearranging the above formula, pipe length can be determined. The length formula is as follows:

$$p_t = \frac{w}{\pi} \frac{(l_t)}{(d_m)}$$

where $p_t$ is the desired length of pipe formed; "$d_m$" is the calculated mean pipe diameter; "w" is the calculated sheet metal width; and "$l_t$" is the measured length of sheet metal used since the initiation of the last saw cycle.

Knowing the pipe length as a function of length of strip 11 used to form pipe allows the saw to be set to begin cutting the pipe when the value indicated by the strip length sensor 24 is at the value necessary to have produced the predetermined length of pipe. This particular feature of my invention is quite useful for continuously producing pipe of various lengths.

In operation, the CPU is set by an operator with the number ($n_t$) of pieces of pipe to make at a given nominal diameter and at what length ($p_t$) to make the pipe (Step 100). The CPU 39 uses calculated mean diameter values ($d_m$) and strip length sensor readings to activate the saw when a desired length is reached (Step 111). A counter is incremented (Step 112) to keep count of the pieces at that given length. When the count for one length of pipe is complete, the CPU is reset with the next length and corresponding count. The process continues until all pipe of all lengths is completed (Step 113). The CPU then stops the pipe machine 10 (Step 114) via stopping means 44.

Although it is possible to use my invention in one embodiment having only a first length sensor $E_oR_o$ and a second length sensor $E_1R_1$, it is preferable to add additional length sensors ($E_2R_2 \ldots E_nR_n$) at additional reference locations. The first pair of length sensors can provide a head calculated mean diameter value ($d_m$) of the head section of the pipe. The additional length sensors ($E_2R_2 \ldots E_nR_n$) can be used to determine diameter values of each section of the pipe. As the pipe continues to be formed, additional diameter values are calculated, (Steps 115–125) each value matching the amount of sheet metal strip used to form a pipe section. Such values may be compared against a desired diameter value and deviations recorded.

The CPU 39 includes a funneling monitoring function in addition to its diameter determining and length determining functions. If the diameters of the sections progressively increase or decrease for the pipe, it indicates that the pipe is being formed in a funnel shape. When such progressively increasing deviations exceed a preset value, the CPU 39 activates a pipe machine stopping means 44, (Steps 121, 127, and 131) and an alarm signal means 45. The operator is then alerted to readjust the diameter control adjustments on the pipe machine 10 to return the pipe to desired diameter values.

The CPU 39 provides a keyboard 40 for entering commands, necessary parameters, and accessing stored information. Length, diameter, and count information is available through a display 41 and hard copy of the information is available on a printer 42.

My invention automaticaly indicates pipe diameter for helical corrugated metal pipe, monitors the diameter for undesirable variations from specified diameter, determines length of pipe formed, and determines the point at which the saw is activated to cut the formed pipe. These functions are accomplished with a degree of accuracy heretofore unavailable to the corrugated pipe forming industry. The present embodiment has achieved accuracies greater than 0.05 inches. The present invention is subject to other embodiments and may be readily adapted to various manufactured helical pipe forming machines. Therefore, the scope of my invention is to be limited only by the claims that follow.

I claim:

1. A process for monitoring the diameter of a helical corrugated metal pipe while the pipe is being formed from a strip of corrugated sheet metal having a known width (w), comprising:

continuously feeding the strip of sheet metal to a corrugated pipe forming station at a feed angle with respect to an intended pipe forming axis;

continuously measuring the length (l) of the strip of sheet metal being fed to the corrugated pipe forming station;

continuously corrugating the strip of sheet metal and continuously forming the corrugated sheet metal into a corrugated pipe at the corrugated pipe forming station and directing the continuously formed corrugated pipe substantially coaxially along the intended pipe forming axis;

sensing the presence of a section of the formed corrugated pipe as it passes a first reference location along the intended pipe forming axis;

sensing the presence of the section of the formed pipe as it passes a second reference location that is spaced a desired distance (p) downstream of the first reference location;

determining the pipe diameter value of the pipe section as a function of sheet metal width (w), pipe section length (p), and length (l) of sheet metal strip used to form the pipe section; and recording the determined pipe diameter value.

2. A process for monitoring the diameter of a helical corrugated metal pipe as claimed in claim 1, further comprising:

sensing the presence of the formed corrugated pipe as it passes additional reference locations sequentially spaced downstream of the second reference location at prescribed distances;

determining pipe diameter values of a plurality of pipe sections as the formed corrugated pipe passes the additional reference locations;

recording the determined pipe diameter values of the plurality of pipe sections.

3. A process for monitoring the diameter of a helical metal corrugated pipe as claimed in claim 1, wherein the determination of pipe diameter further comprises:

calculating a mean pipe diameter of the section of pipe with the aid of a digital computer by applying the formula:

$$d_m = \frac{w}{\pi} \frac{(l)}{(p)}$$

where:

$d_m$=mean pipe diameter w=sheet metal width after corrugation;

p=distance between the first reference point and the second reference point; and l=the measured length of sheet metal used to form the corresponding pipe section.

4. A process for monitoring the diameter of a helical corrugated metal pipe as claimed in claim 2 further comprising:

comparing the determined pipe diameter values with a desired pipe diameter to detect progressively increasing variations between the sections that indicate that the pipe being formed is funneling;

stopping the pipe forming process should progressively increasing variations exceed a preset funneling value.

5. A process for monitoring the diameter of a helical corrugated metal pipe as claimed in claim 4, further comprising:

activating an alarm when the progressively increasing variations exceed the preset funneling value.

6. A process for monitoring the length and diameter of a helical corrugated metal pipe while the pipe is being formed from a strip of corrugated sheet metal having a known width (w) comprising:

continuously feeding the strip of sheet metal to a corrugated pipe forming station at a feed angle with respect to an intended pipe forming axis;

continuously measuring the length (l) of the strip of sheet metal being fed to the corrugated pipe forming station;

continuously corrugating the strip of sheet metal and continuously forming the corrugated sheet metal into a corrugated pipe at the corrugated pipe forming station and directing the continuously formed corrugated pipe substantially coaxially along the intended pipe forming axis;

sensing the presence of a section of the formed corrugated pipe as it passes a first reference location along the intended pipe forming axis;

sensing the presence of the section of formed pipe as it passes a second reference location that is spaced a desired distance (p) downstream of the first reference location;

determining the pipe diameter value of the section of formed pipe as a function of sheet metal width (w), pipe section length (p), and length (l) of sheet metal strip used to form the pipe section;

determining total length of pipe formed ($p_t$) as a function of sheet metal width (w), pipe diameter value, and length (l) of sheet metal strip used to form the pipe; and recording the total length ($p_t$) of pipe.

7. A process for monitoring the length and diameter of a helical metal corrugated pipe as claimed in claim 6, wherein the determination of total pipe length further comprises:

calculating the pipe length with the aid of a digital computer by applying the formula:

$$p_t = \frac{w}{\pi} \frac{(l_t)}{(d_m)};$$

where: $p_t$=total length of pipe formed;

$d_m$=mean pipe diameter;

w=sheet metal width after corrugation; and $l_t$=the measured length of sheet metal used in forming the total pipe.

8. An apparatus for monitoring the diameter of a helical corrugated metal pipe while the pipe is being formed from a strip of corrugated sheet metal having a known width (w) comprising:

feed means for continuously feeding the strip of sheet metal to a corrugated pipe forming station at a feed angle with respect to an intended pipe forming axis;

a strip length sensor for continuously measuring the length (l) of the strip of sheet metal being fed to the corrugated pipe forming station;

corrugating means for continuously corrugating the strip of sheet metal and for continuously forming the corrugated sheet metal into a corrugated pipe at the corrugated pipe forming station and for directing the continuously formed corrugated pipe substantially coaxially along the intended pipe forming axis;

a first length sensor for sensing the presence of a section of the formed corrugated pipe as it passes a first reference location along the intended pipe forming axis;

a second length sensor for sensing the presence of the formed pipe section as it passes a second reference location that is spaced a desired distance (p) downstream of the first reference location;

means for determining the pipe diameter value as a function of the sheet metal width (w), pipe section length (p), and length (l) of sheet metal strip used to form the pipe section; and means for recording the determined pipe diameter.

9. An apparatus for monitoring the diameter of a helical corrugated metal pipe as claimed in claim 8, further comprising:

additional length sensors for sensing the presence of the formed corrugated pipe section as it passes additional reference locations sequentially spaced downstream of the second reference location;

means for determining pipe diameter value of a plurality of pipe sections as the formed corrugated pipe passes the additional length sensors;

means for recording the determined pipe diameter values of the pipe sections as the pipe passes the additional length sensors.

10. An apparatus for monitoring the diameter of a helical metal corrugated pipe as claimed in claim 8, wherein the means for determining pipe diameter further comprises:

a digital computer that calculates the mean pipe diameter by applying the formula:

$$\text{where: } d_m = \frac{w}{\pi} \frac{(l)}{(p)}$$

$d_m$=mean pipe diameter;

w=sheet metal width after corrugation;

p=distance between the first reference point and the second reference point; and l=the measured length of sheet metal used to form the corresponding pipe section.

11. An apparatus for monitoring the diameter of a helical corrugated metal pipe as claimed in claim 9, further comprising:

means for comparing the determined pipe diameter values with a desired pipe diameter to detect progressively increasing variations therebetween that indicate that the pipe is funneling;

means for stopping the pipe forming process should progressively increasing variations exceed a preset funneling value.

12. An apparatus for monitoring the diameter of a helical metal corrugated metal pipe as claimed in claim 11, further comprising:

means for activating an alarm when the progressively increasing variations exceed the preset funneling value.

13. An apparatus for monitoring the length and diameter of a helical corrugated metal pipe while the pipe is being formed from a strip of corrugated sheet metal having a known width (w), comprising:

feed means for continuously feeding the strip of sheet metal to a corrugated pipe forming station at a feed angle with respect to an intended pipe forming axis;

a strip length sensor for continuously measuring the length (l) of the strip of sheet metal being fed to the corrugated pipe forming station;

corrugating means for continuously corrugating the strip of sheet metal and for continuously forming the corrugated sheet metal into a corrugated pipe at the corrugated pipe forming station and for directing the continuously formed corrugated pipe substantially coaxially along the intended pipe forming axis;

a first length sensor for sensing the presence of a section of the formed corrugated pipe as it passes a first reference location along the intended pipe forming axis;

a second length sensor for sensing the presence of the formed pipe section as it passes a second reference location that is spaced a desired distance (p) downstream of the first reference location;

means for determining the pipe diameter value of the section of formed pipe as a function of the sheet metal width (w), pipe section length (p), and length (l) of sheet metal strip used to form the pipe section;

means for determining the total length of pipe formed ($p_t$) as a function of sheet metal width (w), pipe diameter value, and length (l) of sheet metal strip used to form the pipe; and means for recording the total length of the formed pipe.

14. An apparatus for monitoring the length and diameter of a helical corrugated metal pipe as claimed in claim 13, wherein the means for determining the total pipe length further comprises:

a digital computer for calculating the pipe length by applying the formula:

$$p_t = \frac{w}{\pi} \frac{(l_t)}{(d_m)}$$

where: $p_t$=total length of pipe formed;

$d_m$=mean pipe diameter;

w=sheet metal width; and $l_t$=the measured length of sheet metal used in forming the total pipe.

* * * * *